US006145756A

United States Patent [19]

Kohls

[11] Patent Number: 6,145,756

[45] Date of Patent: Nov. 14, 2000

[54] GARDENING APPLICATOR FOR DELIVERING LIQUID CHEMICALS TO SELECTED VEGETATION

[76] Inventor: Corwin Kohls, 989 Patroit Square, Dayton, Ohio 45459

[21] Appl. No.: 09/309,476

[22] Filed: May 1, 1999

[51] Int. Cl.[7] ..... B05B 1/28

[52] U.S. Cl. ..... 239/288; 239/524; 239/428.5; 239/600; 239/333; 239/526

[58] Field of Search ..... 239/288, 288.5, 239/104, 600, 343, 590.3, 120, 499, 524, 428.5, 333, 526; 222/108

[56] References Cited

U.S. PATENT DOCUMENTS

| | | | |
|---|---|---|---|
| 2,514,107 | 7/1950 | Trostler | 239/343 |
| 2,577,024 | 12/1951 | Lundberg | 239/343 |
| 2,597,573 | 5/1952 | Groff . | |
| 2,624,622 | 1/1953 | Holte | 239/343 |
| 2,965,309 | 12/1960 | Parrott | 239/343 |
| 3,094,171 | 6/1963 | Gagliardo | 239/343 |
| 3,935,999 | 2/1976 | Weyn . | |
| 3,946,947 | 3/1976 | Schneider | 239/311 |
| 4,199,896 | 4/1980 | Lehmen . | |
| 4,219,159 | 8/1980 | Wesner | 239/343 |
| 4,789,103 | 12/1988 | Ruhnke | 239/428.5 |
| 4,865,257 | 9/1989 | Bailey . | |
| 4,886,122 | 12/1989 | Goodnight . | |
| 4,986,473 | 1/1991 | Semple et al. . | |
| 5,085,371 | 2/1992 | Paige | 239/428.5 |
| 5,196,065 | 3/1993 | Jozwiak . | |
| 5,310,116 | 5/1994 | Broyhill . | |
| 5,344,076 | 9/1994 | Mercurio . | |
| 5,397,060 | 3/1995 | Maas et al. | 239/343 |
| 5,419,077 | 5/1995 | Tombarelli . | |
| 5,419,493 | 5/1995 | Redway . | |

OTHER PUBLICATIONS

Controller Weeds, Ortho Books pp. 15—25, 27, 37 and 39.

*Primary Examiner*—Andres Kashnikow
*Assistant Examiner*—Dinh Q. Nguyen
*Attorney, Agent, or Firm*—R. William Graham

[57] ABSTRACT

A gardening applicator for efficiently delivering liquid chemicals to selected vegetation is disclosed. The applicator includes a wind guard chamber through which a stream of emitted liquid chemicals may be directed in a predetermined path along a central axis of the wind guard chamber. The wind guard chamber is preferably tube shaped over a predetermined length and can incorporate a diffuser screen or mesh which extends transversely across the predetermined path at the exit end of the wind guard chamber such that the liquid chemicals are finely dispersed upon passing through the diffuser screen. Actuation of a pressure activated pump head may provide a pressurized stream of liquid chemicals through the wind guard chamber and onto the diffuser screen for dispersion onto selected vegetation. The pressure activated pump head may conveniently be connectable to a liquid chemical reservoir such as a generally commercially available bottle with a standard sized threaded opening. The wind guard chamber may further include a drip ring which creates a drip reservoir disposed inside the wind guard chamber. A preferably flared, transparent wind shield may further be provided on the exit end of the wind guard chamber to protect against unwanted overspray onto unintended vegetation.

26 Claims, 16 Drawing Sheets

L
P

GARDENING APPLICATOR FOR DELIVERING LIQUID CHEMICALS TO SELECTED VEGETATION

BACKGROUND OF THE INVENTION

1. Field of the Invention

The disclosed invention relates to liquid chemical applicators for use in gardening applications. More particularly, the invention relates to applicators which effectively control the delivery of liquid chemicals dispersed onto selected weeds or other vegetation, while still protecting adjacent vegetation against unwanted chemical contact. The applicator is also designed to provide the user with optimum personal safety from the liquid chemicals.

2. Related Art

There exist various types of devices and methods for delivering liquid chemicals to vegetation. For example, different prior art methods employ the use of spraying of chemicals directly onto selected weeds or vegetation. The devices involved in the spray methods may include a reservoir of liquid chemicals to which is connected a pumping mechanism and a spray nozzle. Some of these devices are automated while others are manually manipulated.

Regardless of the device or method, it is of concern that the liquid chemicals be delivered to the intended site in a safe and efficient manner. Problems which exist in the art of the delivering such liquid chemicals may include unwanted chemical drift, excessive dripping, and overspray which can occur in a conventional spray application process. Drift may occur as a result of the wind blowing small particles of the liquid chemicals off of their intended path. Dripping may occur as a result of excess liquid chemicals falling out of the nozzle or off of a connected shield, and onto vegetation not intended to be sprayed, as the applicator is moved from one position to another. Drips can thus occur with sprayers that use special guards, bellows, bowls or cardboard shields. Drips can collect on these shields or different devices and fall upon the wrong vegetation. Overspray may occur when the sprayer oversprays the intended vegetation and sprays nearby wrong or unintended vegetation.

There has also been a problem of not being able to stand erect and having to bend over to apply the chemicals with various sprayers. There has been provided by some manufactures a pressurized tank with a fluid extension conduit which is several feet in length having a nozzle at one end in an attempt to address this problem. While this has aided in saving back problems from occurring, it has not addressed the other problems above-mentioned.

Another problem which can exist with many prior devices is that of waste of chemicals which is a by-product of unwanted drift, drip or overspray as previously described. Still, another problem may exist with respect to obtaining effective liquid chemical coverage of the vegetation targeted, which problem is sometimes referred to as poor spray pattern or poor spray pattern coverage. User safety also remains a significant problem.

The disclosed invention aims to address the above-listed and other problems by providing efficient methods and low cost practical devices permitting controlled applications of liquid chemicals to targeted vegetation.

SUMMARY OF THE INVENTION

One object of the invention is to improve gardening and yard work by reducing the time spent on liquid chemical applications such as for weeding.

Another object is to make it easier to apply liquid chemicals while standing erect.

A further object is to minimize dangers to any person using different garden chemicals from accidents or unwanted chemical contact.

It is still another object to improve delivery and safety of applying various liquid chemicals onto intended vegetation and not onto unintended vegetation.

Another object is to improve control of chemical drift, dripping and overspray.

It is yet another object to conserve cost of chemicals by minimizing usage.

It is another object to enable efficient application of liquid chemicals on selected vegetation during windy days or during less than perfect wind conditions.

Accordingly, the invention is directed to a convenient gardening applicator for making gardening easier by improving the delivery system of liquid chemicals onto selected vegetation. The applicator includes a wind guard chamber through which a stream of ejected liquid chemicals may be directed in a predetermined path along a central axis of the wind guard chamber. The wind guard chamber is preferably tube shaped with a predetermined length and constructed of a transparent material.

A diffuser screen or mesh may be connected to the exit end of the wind guard chamber and preferably extends transversely across the predetermined path of the ejected chemical stream. Upon actuating a pressurized chemical source, such as a pressure activated pump head, the liquid chemical may be discharged through a discharging jet or nozzle element, through the wind guard chamber in a relatively straight thin stream and dispersed upon passing through the diffuser screen. The wind guard chamber may further incorporate a drip ring positioned on the inside of the wind guard chamber adjacent the chamber's exit end to collect drips. A preferably detachable and adjustable transparent windshield may be added to the assembly, e.g., at the exit end of the wind guard chamber, to add protection against unwanted chemical drift and overspray.

Other optional features, objects and advantages of the invention will be readily apparent to those skilled in the art upon viewing the appended drawings and reading the detailed description of the presently preferred embodiments hereafter.

DESCRIPTION OF THE PRESENTLY PREFERRED EMBODIMENTS

Figure 1:
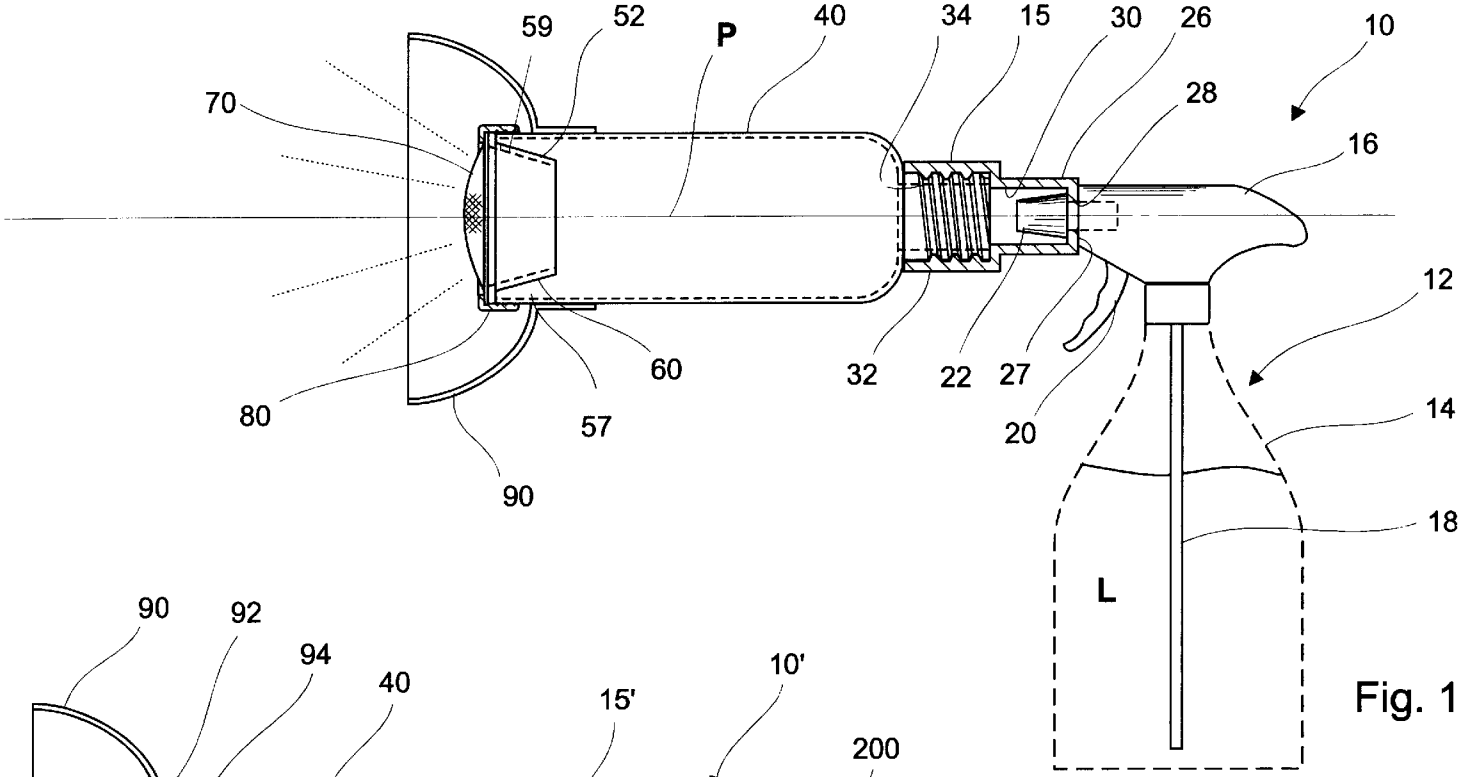
FIG. 1 is a cross-sectional view of a presently preferred embodiment of the invention.

While the invention is discussed herein as applied to gardening, home, yard use and the like, it is understood that other applications of the disclosed invention, such as commercial applications, will be apparent to those skilled in the art. And while the disclosed applicators are particularly useful for weed control and eradication of unwanted vegetation, it will be appreciated that they may also be advantageously deployed for controlled application of insecticides, nutrients, fertilizers and other liquid chemicals.

Referring now to the drawings, the presently preferred embodiments of gardening applicators according to the invention are generally depicted by the numerals 10, 10' and 10", where 10, 10' 10", 10''', 10 "", 10''''', 10'''''', 10''''''', 10'''''''', 10''''''''', 10'''''''''', 10''''''''''', 10'''''''''''', represent different embodiments shown in FIGS. 1, 3, 4, 6–8. The applicator embodiments 10, 10' and 10", where 10, 10' 10", 10''', 10'''', 10''''', 10'''''', 10''''''', 10'''''''', 10''''''''', 10'''''''''', 10''''''''''', 10'''''''''''', may include common elements and the numerals referred to herein will thus be the same where common elements are illustrated.

The illustrated gardening applicators 10, 10' and 10", where 10, 10' 10", 10''', 10'''', 10''''', 10'''''', 10''''''', 10'''''''', 10''''''''', 10'''''''''', 10''''''''''', 10'''''''''''' can predominantly be made of plastic materials, such as moldable thermoplastics, but other materials of natural or synthetic compositions can also be employed. Transparent materials can be particularly advantageous and are preferred where their use will facilitate visualization of the chemicals being applied.

As shown in FIG. 1, the gardening applicator 10 may be configured to be adapted to a conventional liquid chemical bottle 12. The depicted liquid chemical bottle 12 comprises a container 14 having a standard sized threaded opening attached to a pressure activated pump head 16 which is equipped with a lower feed line 18, a pump trigger 20 and a detachable discharging jet 22 that may be generally configured as known in the art. The discharging jet 22 is preferably threaded to the pressure activated pump head 16 and comprises an orifice 23 (shown in FIG. 5) through which a stream or spray of liquid chemical L may be discharged along a predetermined path P.

Figure 5:
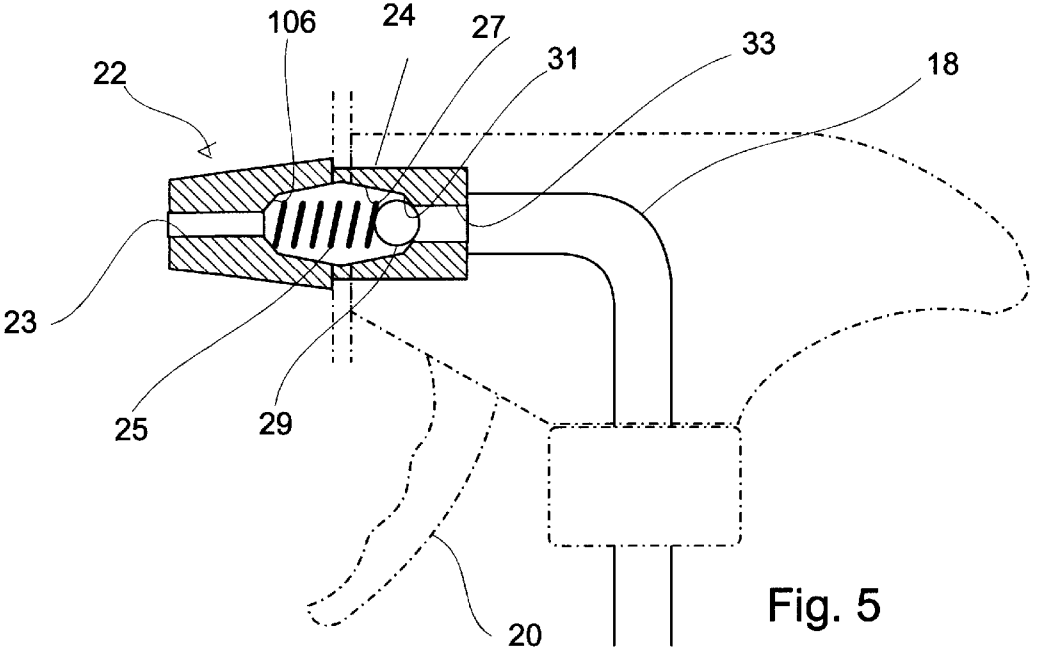
FIG. 5 is a part cross-sectional view of exemplary parts (discharging jet 22 and pressure control assembly 24) of the invention embodiments shown, e.g., in FIGS. 1, 2 and 4.

The discharging jet 22 may include a pump pressure control assembly 24 therein as depicted in FIG. 5, for example. The pump pressure control assembly 24 may include a non-drip check ball valve readily known in the art, but could include various other available check valves which would serve this exemplary function in the invention. The illustrated pressure pump control assembly 24, for example, includes a spring 25 disposed in a chamber 27 and a ball 29 which is biased against an orifice seat 31 within the discharging jet 22. A communicating port 33 interconnects upper portion of feed line 18 and orifice 23. The pump trigger 20 builds pressure to enable fluid flow in the direction of the discharging jet 22 from the feed line 18. Upon reaching a predetermined pressure in the feed line 18, liquid L is forced through the exemplary pressure control assembly 24 by displacing the ball 29 from the orifice seat 31 thus emitting liquid L through the orifice 23 at a controlled pressure level.

A wind guard chamber 40 is also provided and a presently preferred example is depicted in FIGS. 1,2, 3, 6–9, and 10–15. The chamber 40 as specifically described herein in FIG. 2 has a first end 42 which may be formed with a hollow neck 44 having an outer threaded surface 46 configured to be complementary threaded to the threaded internal surface 34 of a coupling collar 15. The wind guard chamber 40 is preferably of a sufficient inner diameter, for example 2 to 3 inches, to avoid contacting the discharged stream or spray of liquid chemical L along the spray path P. The length of the chamber 40 should preferably be long enough to allow the pressurized liquid chemical to impinge upon the difuser screen 70 with suficient force to provide a uniform circular pattern onto the target plant area upon exiting the difuser screen 70 to permit a user to carry out use of the invention, for example, spraying weeds without having to unduly bend over in order to assure that liquid L hits the intended target. The length can be for example, a foot or so. A second end 48 of the chamber 40 can also be formed with an outer threaded surface 50 for purposes of attaching drip ring 52, diffuser screen 70 and windshield 90 elements to be further described herein.

The wind guard chamber 40 may be conveniently coupled to and removed from the applicator 10 using a connector such as an annular internally threaded collar 15 as depicted in FIG. 1. The illustrated exemplary collar 15 is generally hollow and has a first end 26 formed with an opening 28 which is slightly larger in diameter than the diameter of a threaded end of the discharging jet 22 that secures the collar 15 to the pressure activated pump head 16. The male threaded end of the discharging jet 22 engages within a female threaded opening in a neck on the forward end of the pressure activated pump head 16. An inner open surface 30 formed within the first end 26 of the collar 15 is larger than a flanged head comprising the discharging jet 22 to accommodate housing the same. The collar 15 has a second end 32 that includes a female threaded internal surface 34 to engage male threaded surface 46 of neck 44 of the wind guard chamber 40. The collar end 32 is sized to permit access to the discharging jet 22 for connecting it to and disconnecting it from the pressure activated pump head 16, e.g., via a hex head profile or an Allen-hex or slot opening (not shown) comprising the flanged head of the discharging jet 22. The end 26 of the collar 15 may be thus secured to between the pressure activated pump head 16, locking in place the collar 15 for connecting the wind guard 40 to the applicator 10 by a hand tightened engagement.

Figures 2, 2A, 2B, 2C, 2D, 2E, 2F:
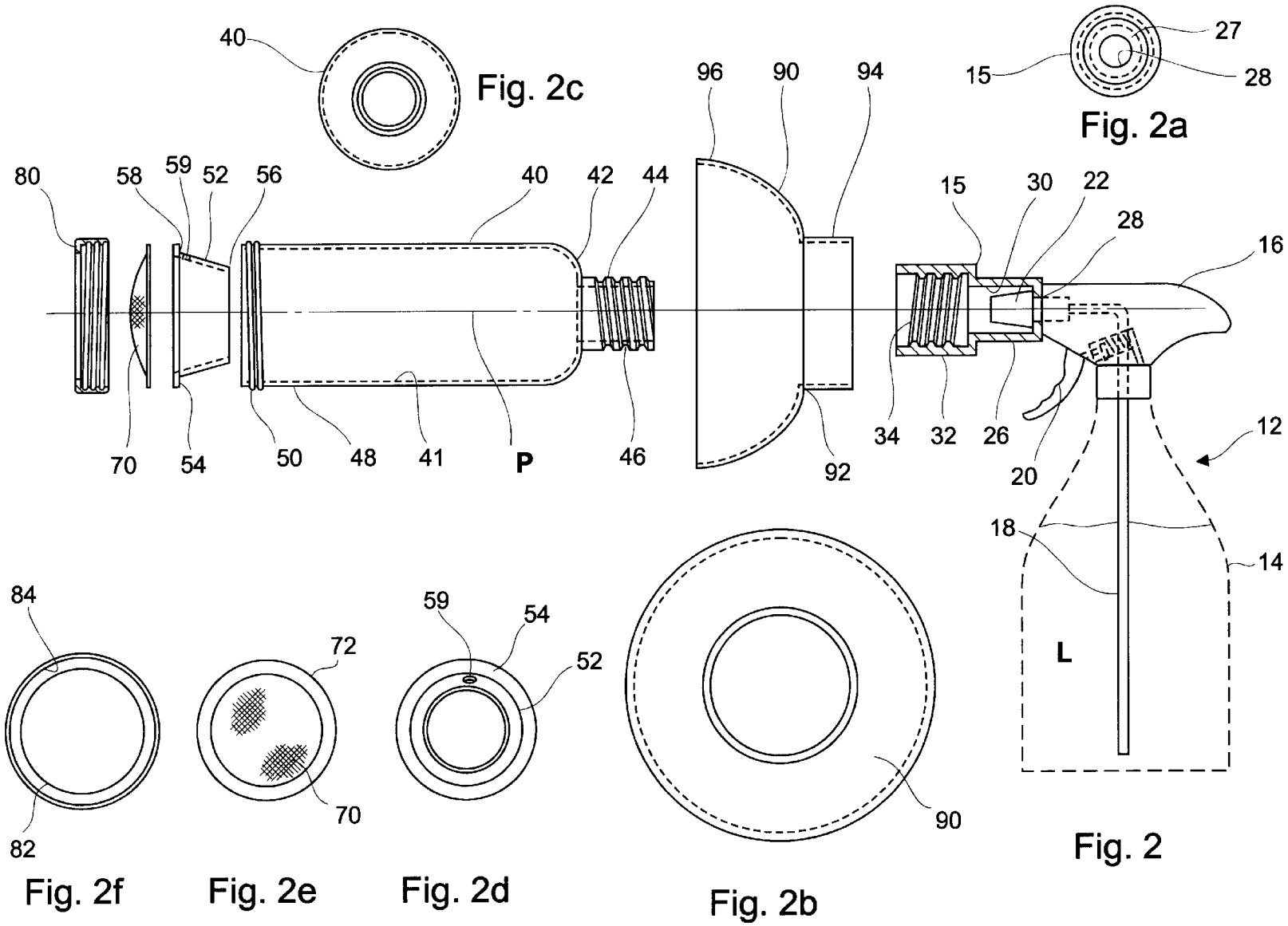
FIG. 2 is an exploded view of the embodiment in FIG. 1.
FIG. 2*a* is an end view of a part (connecting collar 15) of the embodiment in FIG. 1.
FIG. 2*b* is an end view of another part (windshield 90) of the embodiment in FIG. 1.
FIG. 2*c* is an end view of still another part (wind guard chamber 40) of the embodiment in FIG. 1.
FIG. 2*d* is an end view of yet another part (drip ring 52) of the embodiment in FIG. 1.
FIG. 2*e* is an end view of another part (diffuser screen 70) of the embodiment in FIG. 1.
FIG. 2*f* is an end view of again another part (cap ring 80) of the embodiment in FIG. 1.

A drip ring 52 may be generally frustoconical shaped and may include an annular sealing lip 54 and is best illustrated in FIGS. 1, 2, and 2*d*. The illustrated exemplary drip ring 52 has an end 56 of sufficient smaller diameter than a diameter of inner surface 41 of the chamber 40 such that a reservoir space 57 is formed therebetween. Another end 58 of the illustrated drip ring 52 is larger in diameter than the drip ring end 56, but slightly smaller than the diameter of inner surface 41 of the chamber 40. The sealing lip 54 extends radially outward from the drip ring end 58 and is approximately equal in diameter to the end 48 of the chamber 40 to seat against the chamber end 48 to form a seal therebetween. As shown, the reservoir space 57 is defined by an outer surface 60 of the ring 52 and a portion of the inner surface 41 adjacent chamber end 48.

A drain 59 may extend through the drip ring 52 preferably near the end 58. The drain 59 is preferably positioned at the top of the wind guard chamber 40 when connected to the bottle 12 as seen in FIG. 1. In this way, the excess liquid L in the reservoir space 57 can be emptied therefrom when tilting the wind guard chamber 40 in a downward direction allowing liquid L to travel out of the drain 59 onto an arcuate diffuser screen 70 hereinafter described. This permits emptying of excess liquid L at a safe location where emptied chemicals can be recovered or otherwise do no harm.

An exemplary arcuate diffuser screen or mesh 70 is best illustrated in FIGS. 1, 2, and 2*e*, for example. The diffuser screen 70 is illustrated as having a diameter approximately that of the sealing lip 54 and as including a portion 72 which seats against the drip ring sealing lip 54. The diffuser screen 70 is designed with a mesh opening size to enable dispersion of the liquid chemical L received from the discharging jet 22 along path P, as seen in FIG. 1. It is to be understood that the mesh opening size is sized to achieve a desired dispersion, and that ideal sizing may vary according to ambient outside conditions and the chemicals used. Hence, it may be advantageous to employ a variable effective mesh size diffuser screen to accommodate a variety of chemicals and conditions. Such a device may, for example, be constructed using a stacked pair of finely slotted disks that can be rotated with respect to one another to make effective screen size adjustments. Alternatively, different mesh size accessory diffuser screens may be provided and alternately used as desired. Ready ability to install and remove accessory screens may thus be a desired implementation feature for diffuser screen interchange as well as for general serviceability of the parts. The effect achieved via the diffuser screen 70 can be important in that it permits a more uniform application of the liquid chemical L targeted vegetation whereby the vegetation is substantially able to be covered with the liquid chemical L by an economical and efficient spray pattern. Preferably, the pressurized stream of liquid chemical L from the activated pump head 16 impinges upon a cental region of the diffuser screen 70 to provide a uniform circular pattern to the target plant area upon exiting diffuser screen 70. The liquid L substantially avoids direct contact with the wind guard chamber 40 prior to contacting the diffuser screen 70. Further, the applicator 10 with its connected chamber 40 is of a size. The surface area and mesh size of the diffuser screen 70 are preferably such as to catch and maintain drips from the discharging jet 22 and prevent dripping liquid chemical L when moving from one plant to the next plant.

An exemplary annular cap ring 80 is best illustrated in FIGS. 1, 2, and 2*f*, for example, and may be used to hold the diffuser screen 70 and drip ring 52 in place against the wind guard chamber 40. The cap ring 80 may include a radially inwardly extending lip portion 82 to retain the parts. An inner surface 84 of the cap ring 80 may be threaded in a complementary manner to connect to threaded surface 50 of chamber 40.

Additionally, a windshield 90 may be provided, e.g., as depicted in FIGS. 1, 2, and 2*b*, for example. The illustrated arcuate windshield 90 has a first end 92 configured with a sleeve 94 having an inner diameter sized to enable it to be frictionably slidably disposed about the chamber 40 and retained from sliding off the second end 48 by the cap ring 80. Second end 96 of the windshield 90 may be flared or have a substantially widened radius with respect to a radius of the end 48 of chamber 40 to permit the dispersed spray to reach the intended target area while shielding the same from wind, e.g, as seen in FIG. 1.

Figure 3:
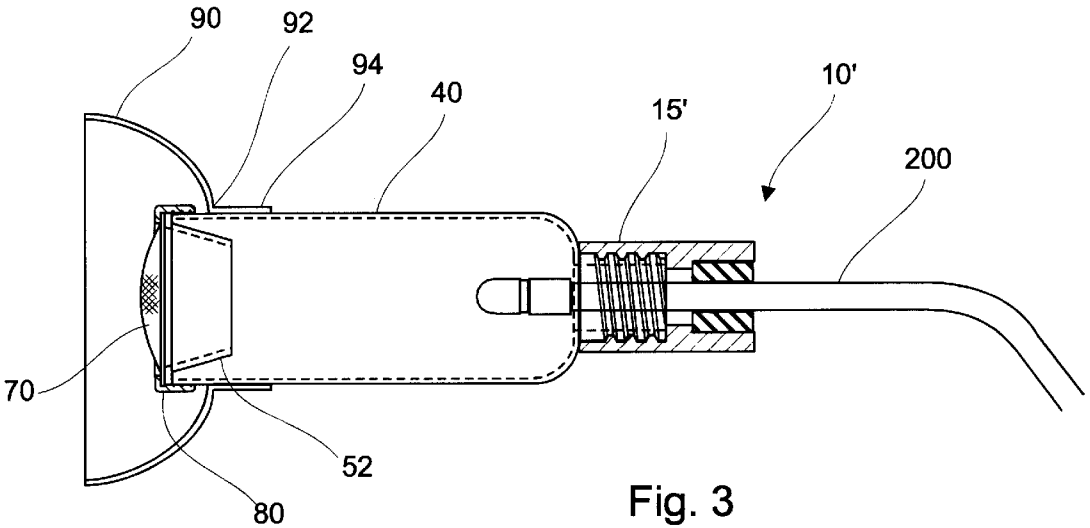
FIG. 3 is a cross-sectional view of another embodiment of the invention adapted for use, e.g., as part of a wand type applicator.
Figure 3C:
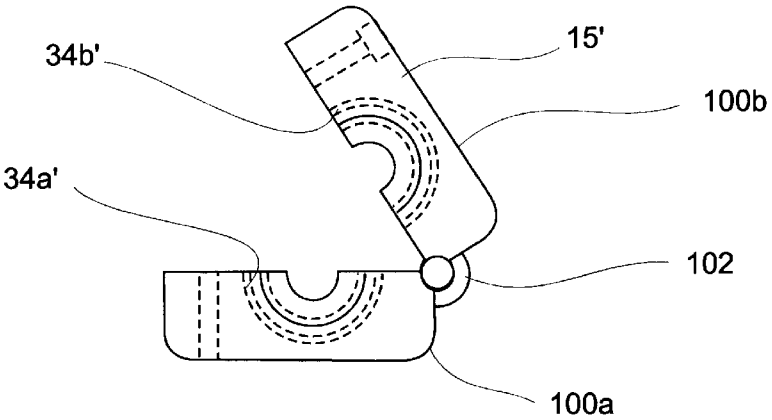
FIG. 3*c* is an end view of the part (collar 15') in FIG. 3*a* in an open position.
Figure 3B:
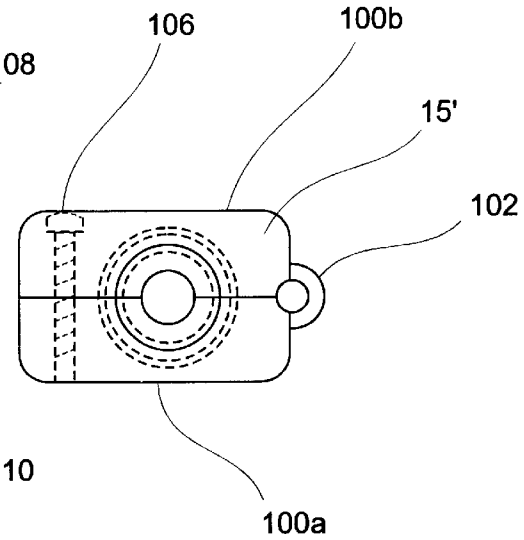
FIG. 3*b* is an end view of the part (collar 15') in FIG. 3*a*.
Figure 3A:
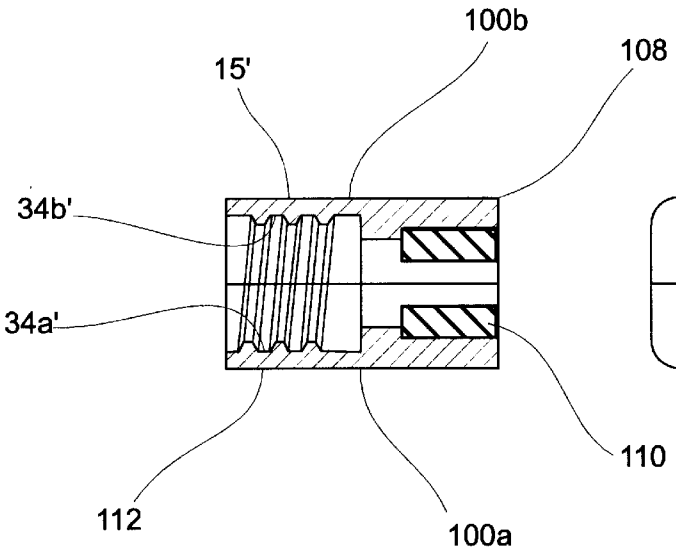
FIG. 3*a* is a cross sectional view of a part (collar 15') of the embodiment in FIG. 3.
Figure 3D:
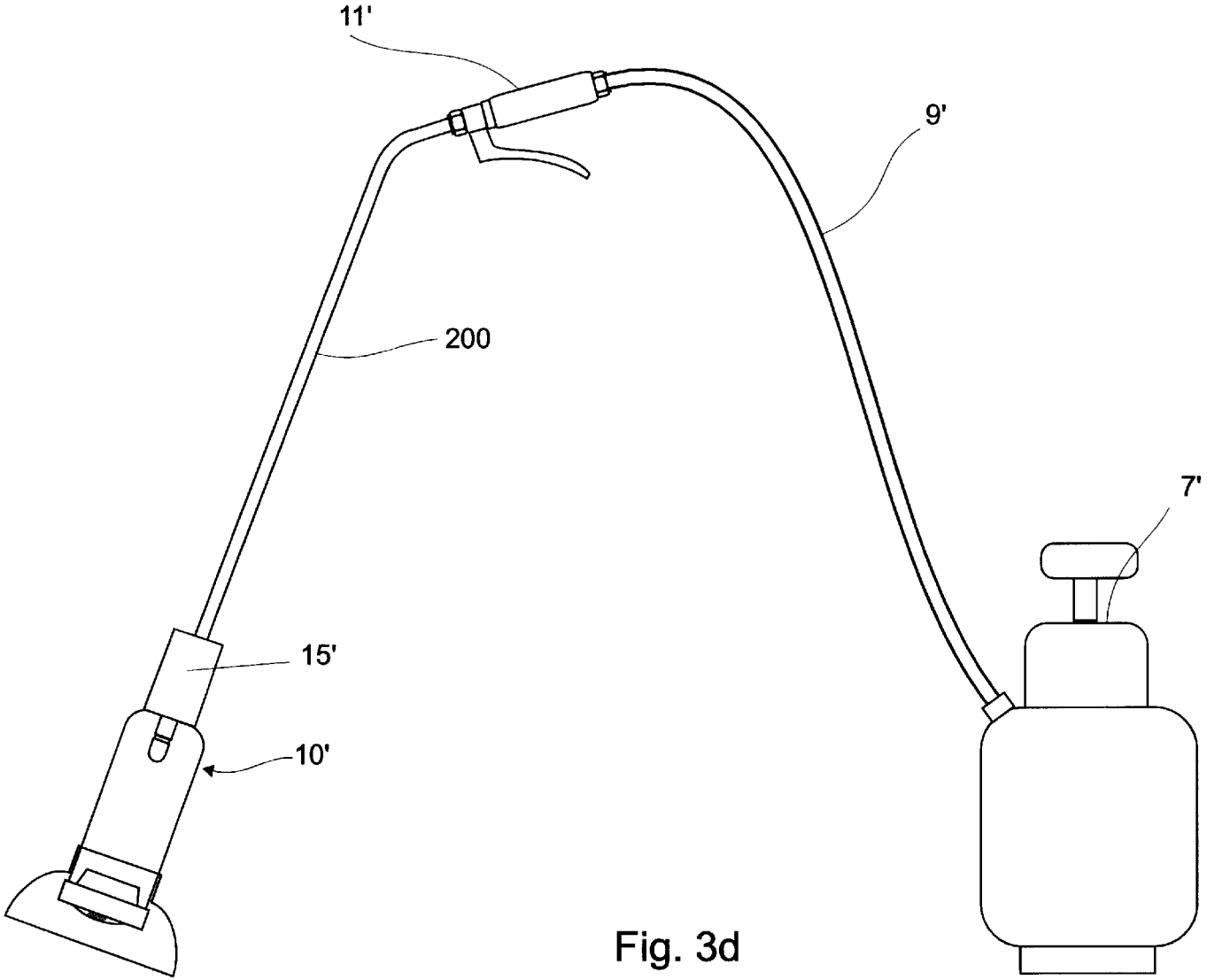
FIG. 3*d* depicts the embodiment of FIG. 3 connected to a conventional liquid pressure tank.

Depicted in FIGS. 3 and 3*d* is an alternative embodiment 10' for use on a fluid extension conduit or wand 200. Here, the illustrated applicator 10' incorporates an alternative exemplary collar 15' shown in FIGS. 3, 3*a–d*. FIG. 3*d* shows the embodiment 10' connected to a conventional liquid pressure tank 7' via a pressure hose 9' and squeeze trigger handle 11'. The collar 15' may comprise two symmetrical halves 100*a* and 100*b* which are hingedly connected at one side by an integral flexible plastic hinge 102. The two halves of the collar 15' may respectively include complementary female threaded surfaces 34'*a* and 34'*b*. A retaining screw 106 can be threaded into the collar 15' in the closed position as seen in FIG. 3*b*. One end 108 of the collar 15' may include gripping collar pads 110, in the form of a rubber washer, for example, disposed about the wand 200. The collar 15' has another end 112 through which the female threaded inner surfaces 34'a and 34'b may receive the male threaded surface 46 of neck 44 of the wind guard chamber 40.

Figure 4:
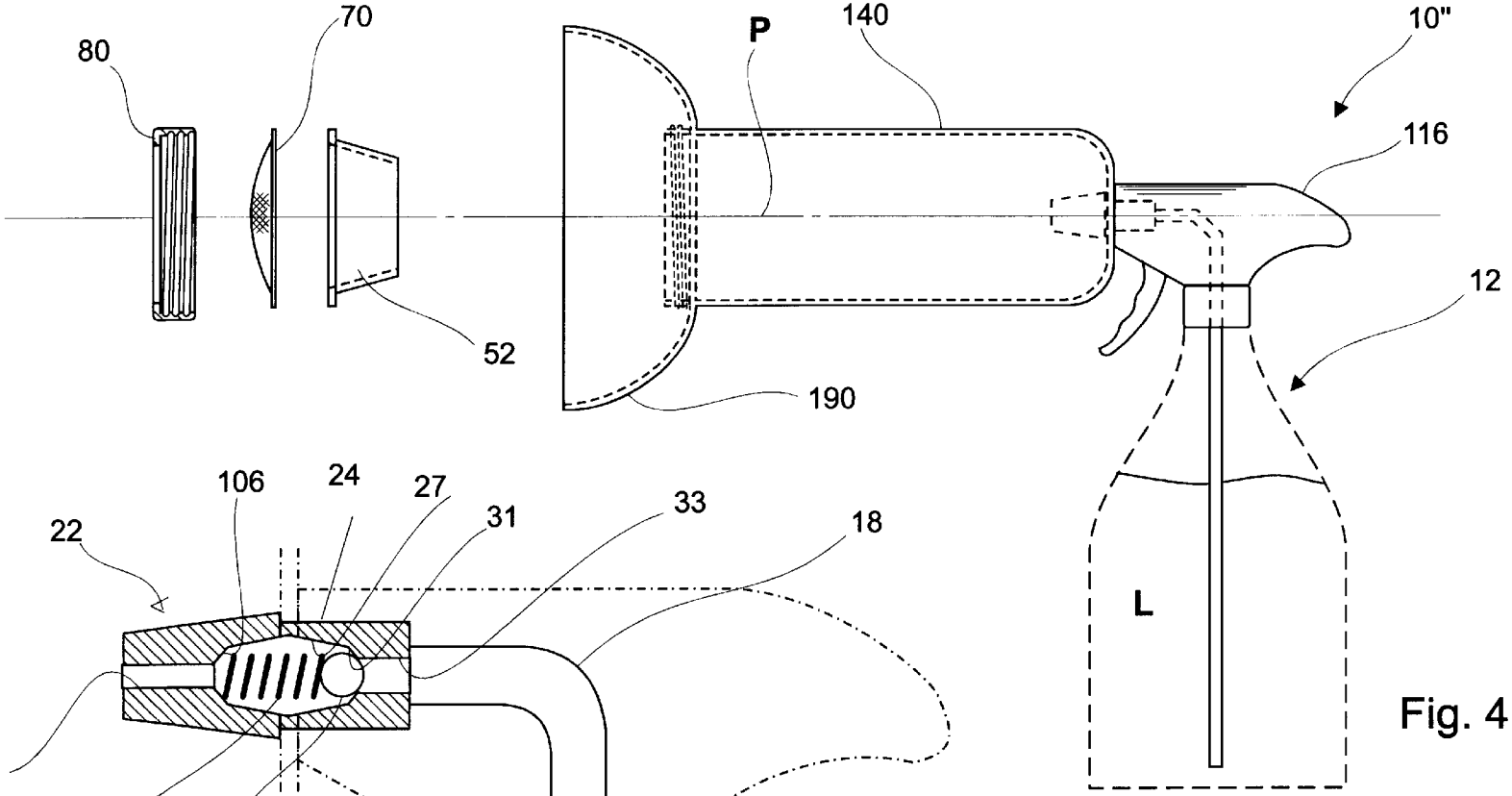
FIG. 4 is an exploded view of another embodiment of the invention with integrally formed elements.

FIG. 4 depicts another embodiment 10" having a substantially integrally formed wind guard chamber 140, windshield 190 and pump head 116. The pump head 116 may be threadably connectable to the bottle 12 and the chamber 140 may be connectable to parts 52, 70 and 80 as described above for the other embodiments.

Figure 6:
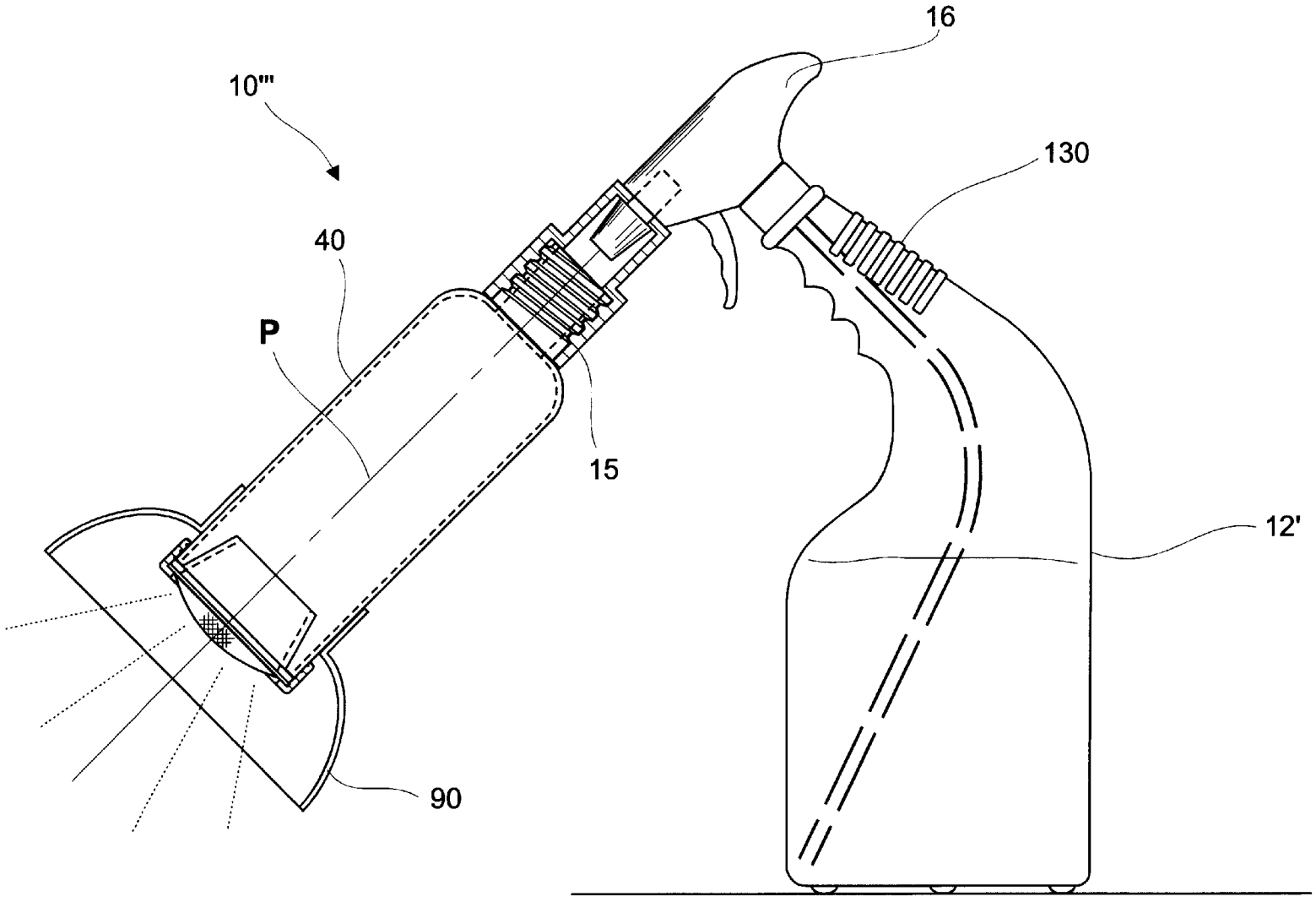
FIG. 6 is a cross-sectional view of another embodiment of the invention having an attached chemical reservoir bottle with an angled neck with gripping surfaces forming an integral handle.
Figure 7:
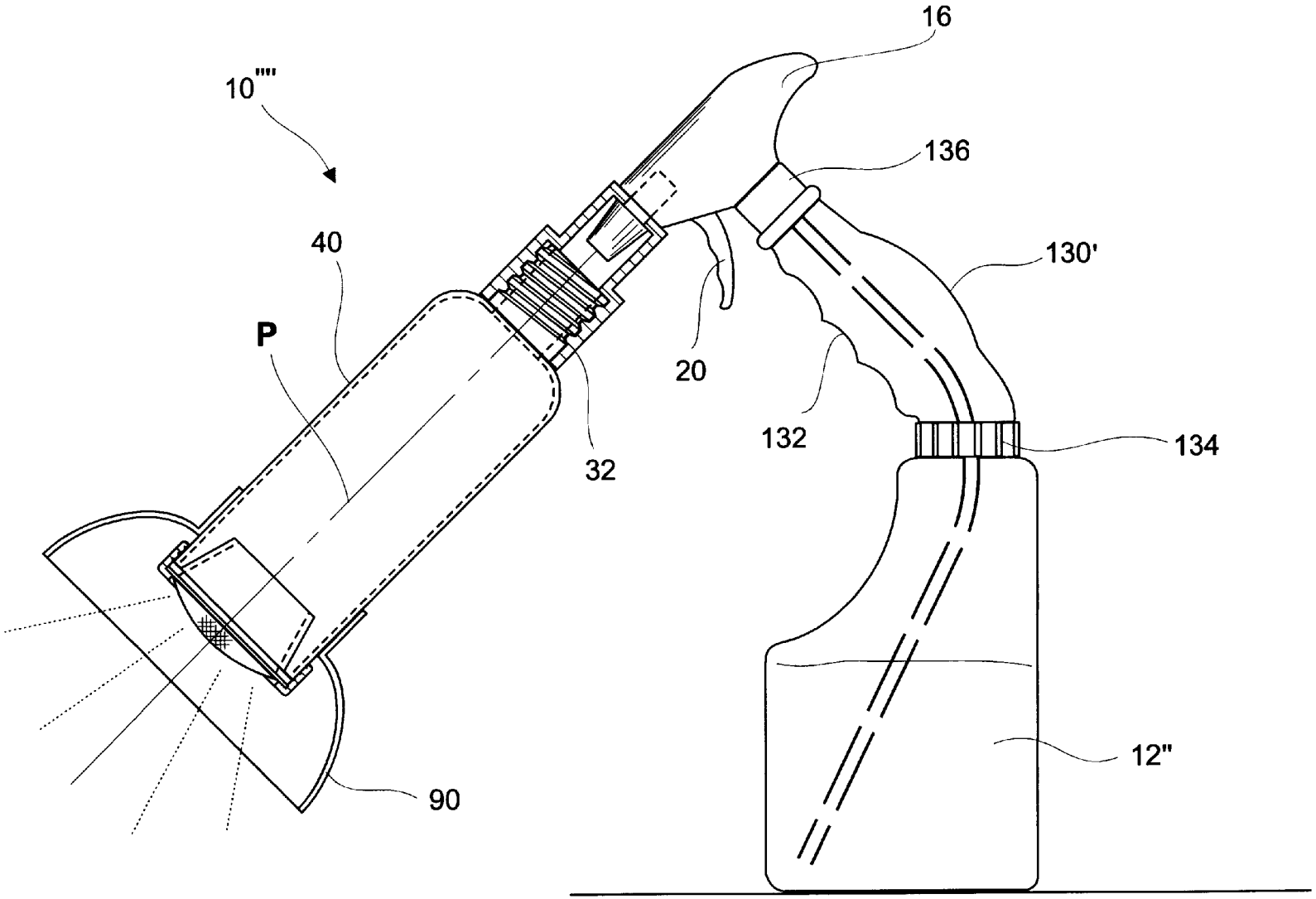
FIG. 7 is a cross-sectional view of the embodiment of FIG. 6 with an attached conventional chemical reservoir bottle and an angled connector neck with gripping surfaces forming a handle.

FIG. 6 exemplifies a preferred embodiment feature of the invention wherein an integrally formed bent handle 130 is incorporated in the chemical reservoir bottle 12' for applicator 10'''. FIG. 7 depicts another embodiment applicator 10'''' which differs from the embodiment in FIG. 6 in that there is provided a handle adapter 130' which may include a gripping surface and connected universal chemical bottle 12". An end 134 of the handle adapter 130' includes a female inner threaded surface to thread to the neck of the bottle 12". Another end 136 of the adaptor 130' may have a male internal threaded surface for threaded connection to pump head 16. The illustrated handle adapter 130' incorporates a bend angle of about 45 degrees; however, other degrees of bend may also be suitable for aid in using the invention. The bend in the handle adapter 130' can provide the user a more comfortable operation due to a natural balancing of weight wherein the chemical bottle 12" hangs down by gravity while the path P remains focused on the intended ground target.

Figure 8:
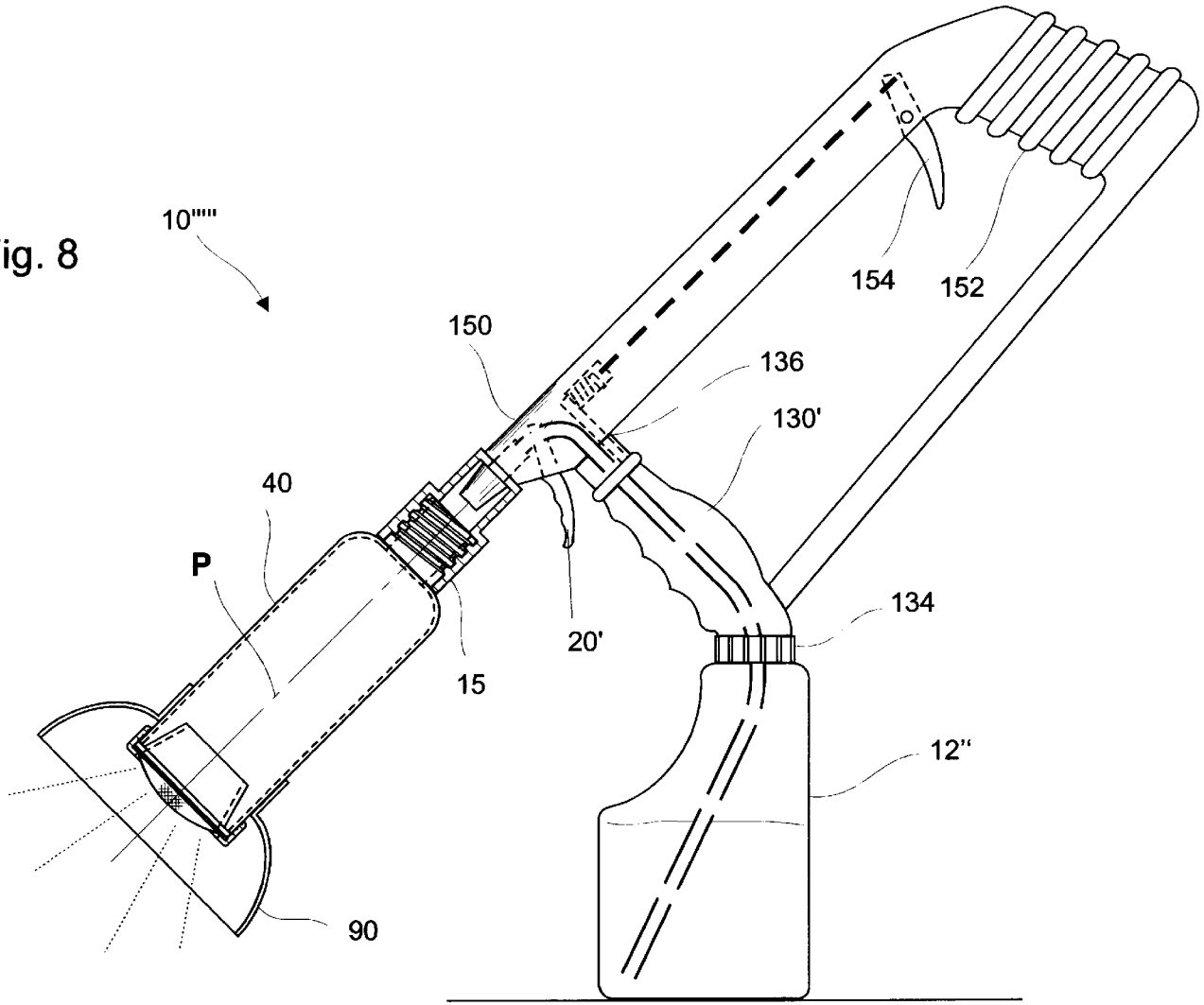
FIG. 8 shows a cross-sectional view of yet another embodiment of the invention having an extended bent handle assembly a bent handle adapter for connecting to a straight-necked chemical reservoir bottle.

FIG. 8 depicts another embodiment of an applicator 10''''' connected to the applicator handle adapter 130' and bottler 12". As further shown in FIG. 8, in the applicator embodiment 10''''', an elongated pump head 150 incorporates an integral handle 152 and an auxiliary a pump trigger 154 which are disposed rearwardly of the connection between the bottle 12" and the elongated pump head 150. The pump trigger 154 is operably connected to pump trigger 20' to enable pressurization.

Figure 9:
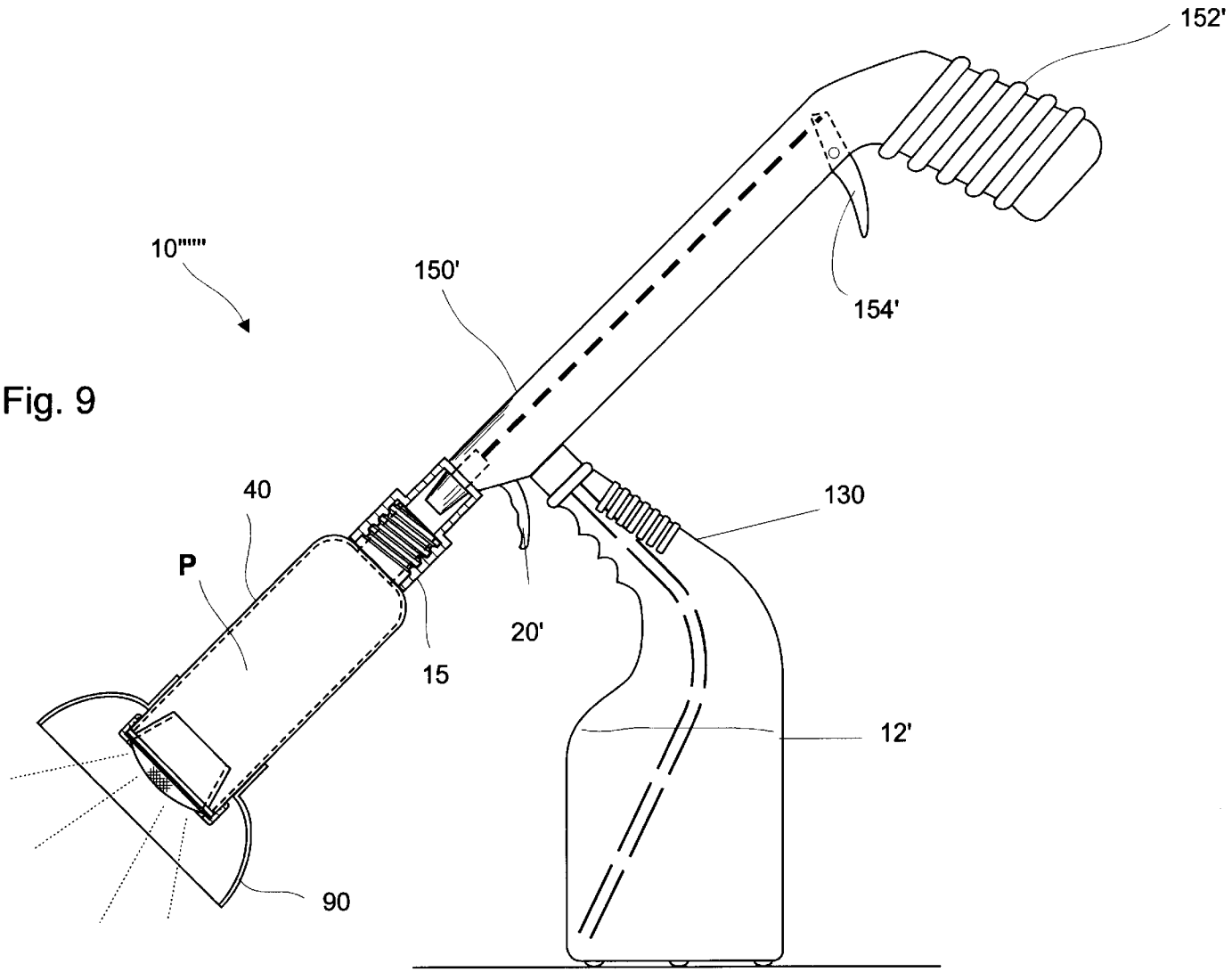
FIG. 9 shows a cross-sectional view of still another embodiment of the invention having an extended bent handle assembly and an attached chemical reservoir bottle with an angled neck with gripping surfaces forming an integral handle.

FIG. 9 illustrates applicator 10'''''', a further bent handle embodiment of the invention. FIG. 9 depicts the elongated pump head 150' with integrally formed rearward handle 152' and an integrally formed bent handle 130 in the reservoir bottle 12'. Similarly, the rearward handle 152' includes an auxiliary trigger 154'.

Figure 9A:
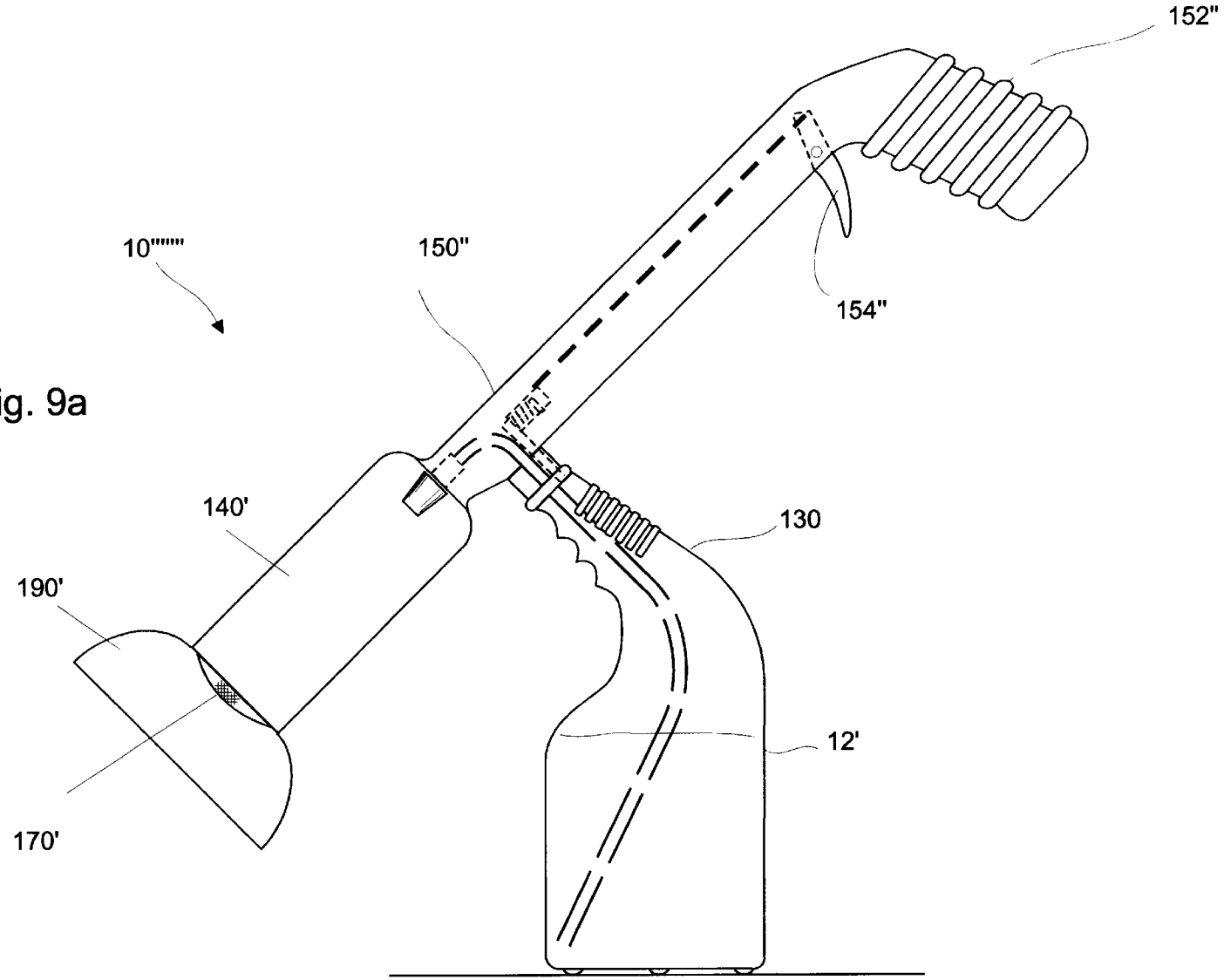
FIG. 9*a* shows a cross-sectional view of still another embodiment of the invention having an extended bent handle assembly and an attached chemical reservoir bottle with an angled neck with gripping surfaces forming all of which is integrally formed.

FIG. 9*a* illustrates applicator 10''''''', a further bent handle embodiment of the invention. FIG. 9*a* depicts the elongated pump head 150" integrally formed rearward handle 152", integrally formed wind shield 190', screen diffuser 170' and chamber 140' connected to an integrally formed bent handle 130 in the reservoir bottle 12'. Similarly, the rearward handle 152" includes a trigger 154" which is operably connected to the bottle 12'.

Figure 10:
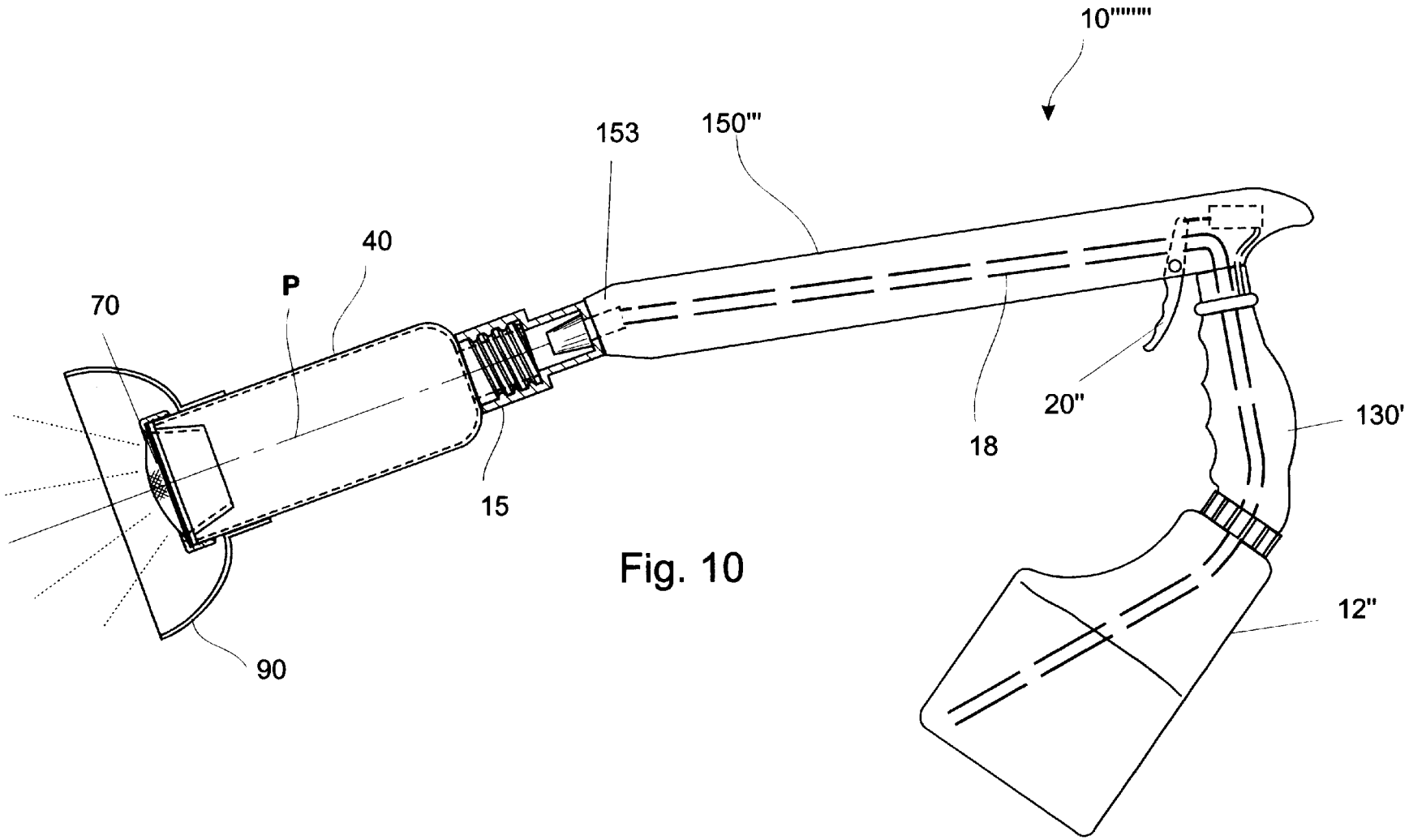
FIG. 10 shows a cross-sectional view of yet another embodiment of the invention having an extended bent handle assembly and an attached chemical reservoir bottle with an angled connector neck with gripping surfaces forming a handle.

FIG. 10 illustrates another applicator 10'''''''', a further bent handle embodiment of the invention. FIG. 10 depicts the elongated pump head 150''' formed with a rearwardly disposed pump trigger 20", connected to bent handle adapter 130' and the reservoir bottle 12". Here, a forward end 153 of the pump head 150''' is formed in a manner to enable connection of the collar 15 and chamber 40 at an angle relative thereto.

Figure 11:
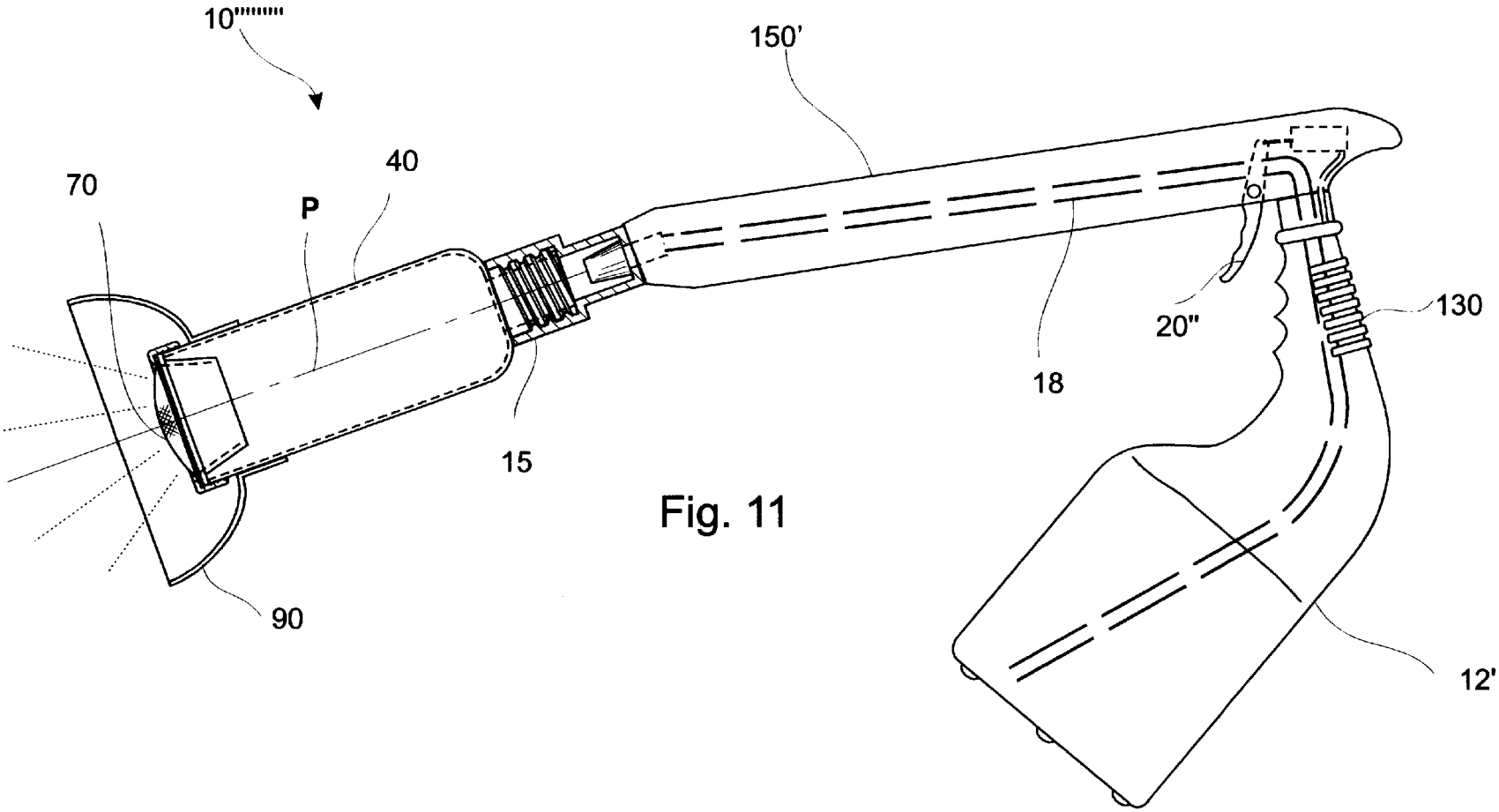
FIG. 11 shows a cross-sectional view of again still another embodiment of the invention having an extended bent handle assembly and an attached chemical reservoir bottle with an angled neck with gripping surfaces forming an integral handle.

FIG. 11 illustrates another applicator 10''''''''', another bent handle embodiment of the invention. FIG. 11 depicts the elongated pump head 150''' as similarly shown in FIG. 10, connected to integrally formed bent handle adapter 130 and the reservoir bottle 12'. Here, a forward end 153 of the pump head 150''' is formed in a manner to enable connection of the collar 15 and chamber 40 at an angle relative thereto.

Figure 12:
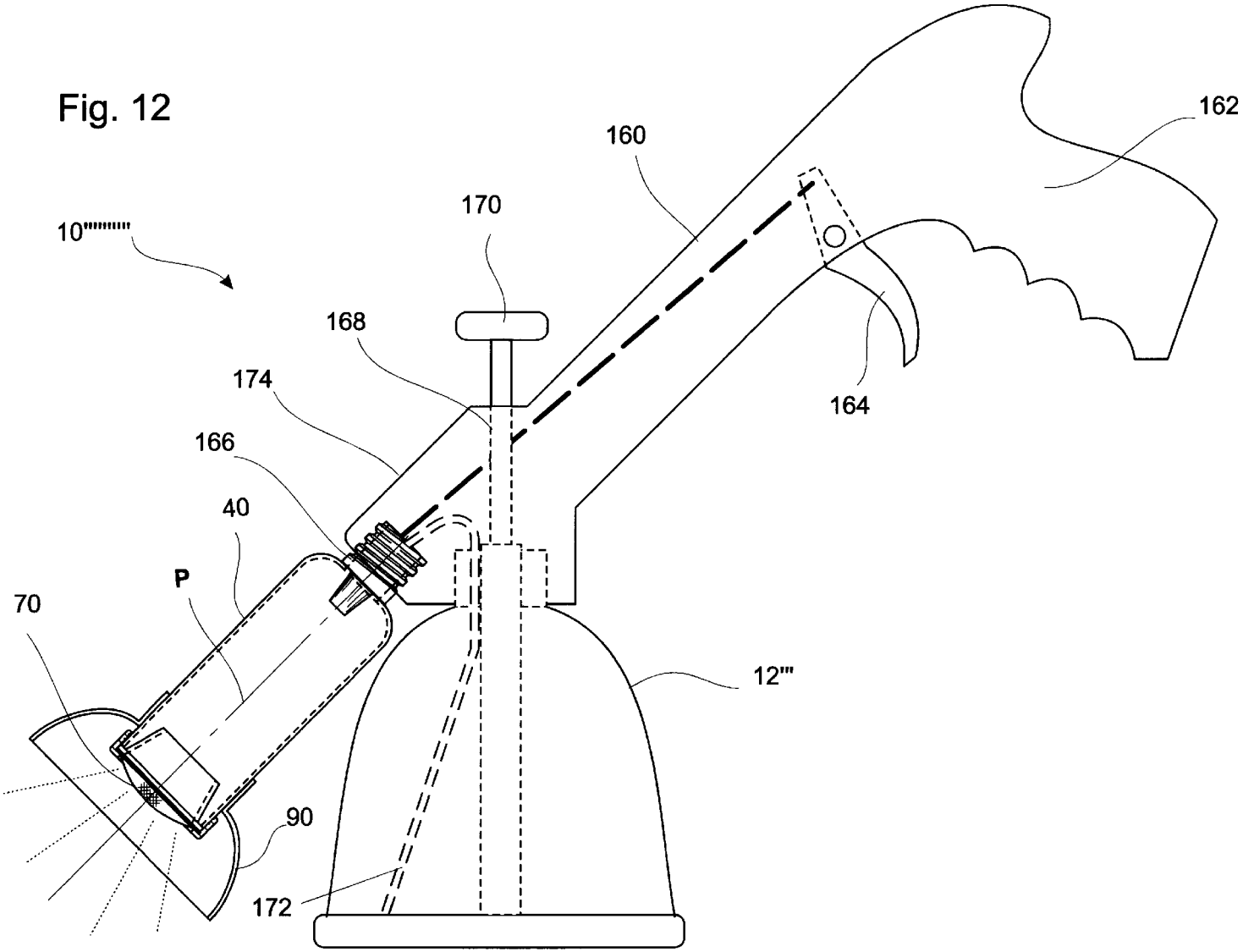
FIG. 12 shows a cross-sectional view of still another embodiment of the invention having an extended handle assembly and an attached chemical pump reservoir bottle.

FIG. 12 illustrates another applicator 10'''''''''' adapted for connection to a pump pressure tank 12'''. Included is an elongated pump head 160 formed with a rearward handle 162 having a valve trigger 164 which may be connected to a release valve (not shown) in the pump head assembly 166. The pump head 160 may be formed with a suitable open surface 168 adjacent a connection of the tank 12''' to slidably receive a pump piston 170 therethrough. A feed line 172 communicably extends from the tank 12''' to pump head assembly 166. The pump piston 170 is used to achieve pressurization in the tank 12''' through reciprocation thereof. The tank 12''' is connected to the pump head 160 such that the same is at an angle and likewise a forward end 174 of the pump head 160 is formed in a manner to enable connection of the chamber 40 at an angle relative to the tank 12'''.

Figure 13:
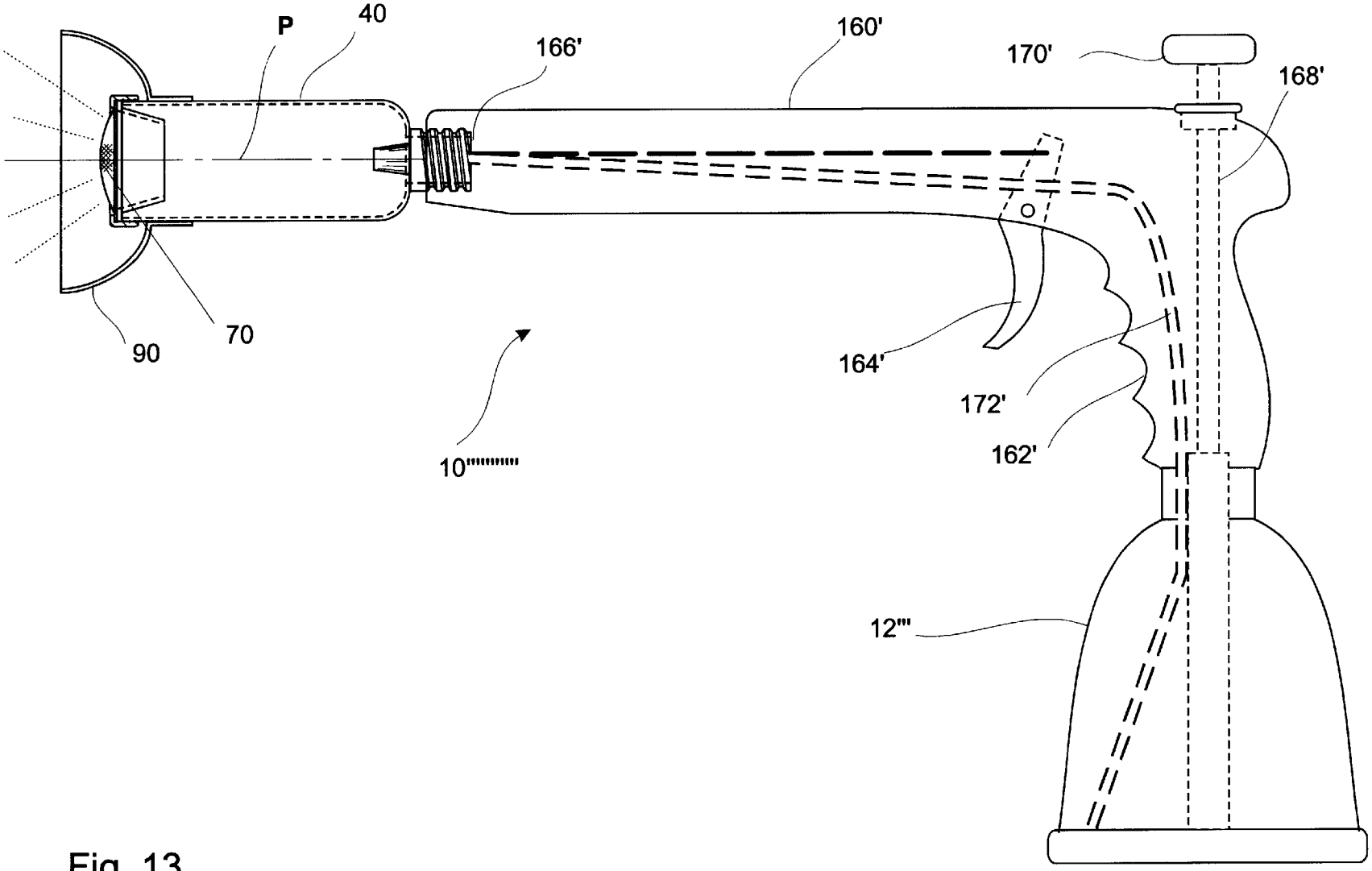
FIG. 13 shows a cross-sectional view of yet another embodiment of the invention having an extended handle assembly and an attached chemical pump reservoir bottle.

FIG. 13 illustrates another applicator 10''''''''''' adapted for connection to a pump pressure tank 12'''. Included is an elongated pump head 160' formed with a rearward handle 162' having a valve trigger 164' which may be connected to a release valve (not shown) in the pump head assembly 166'. Here, the pump head 160' may be formed with a suitable open surface 168' through the handle 162' adjacent a handle connection to the tank 12''' to slidably receive pump piston 170' therethrough. A feed line 172' communicably extends from the tank 12''' to pump head assembly 166'.

Figure 14:
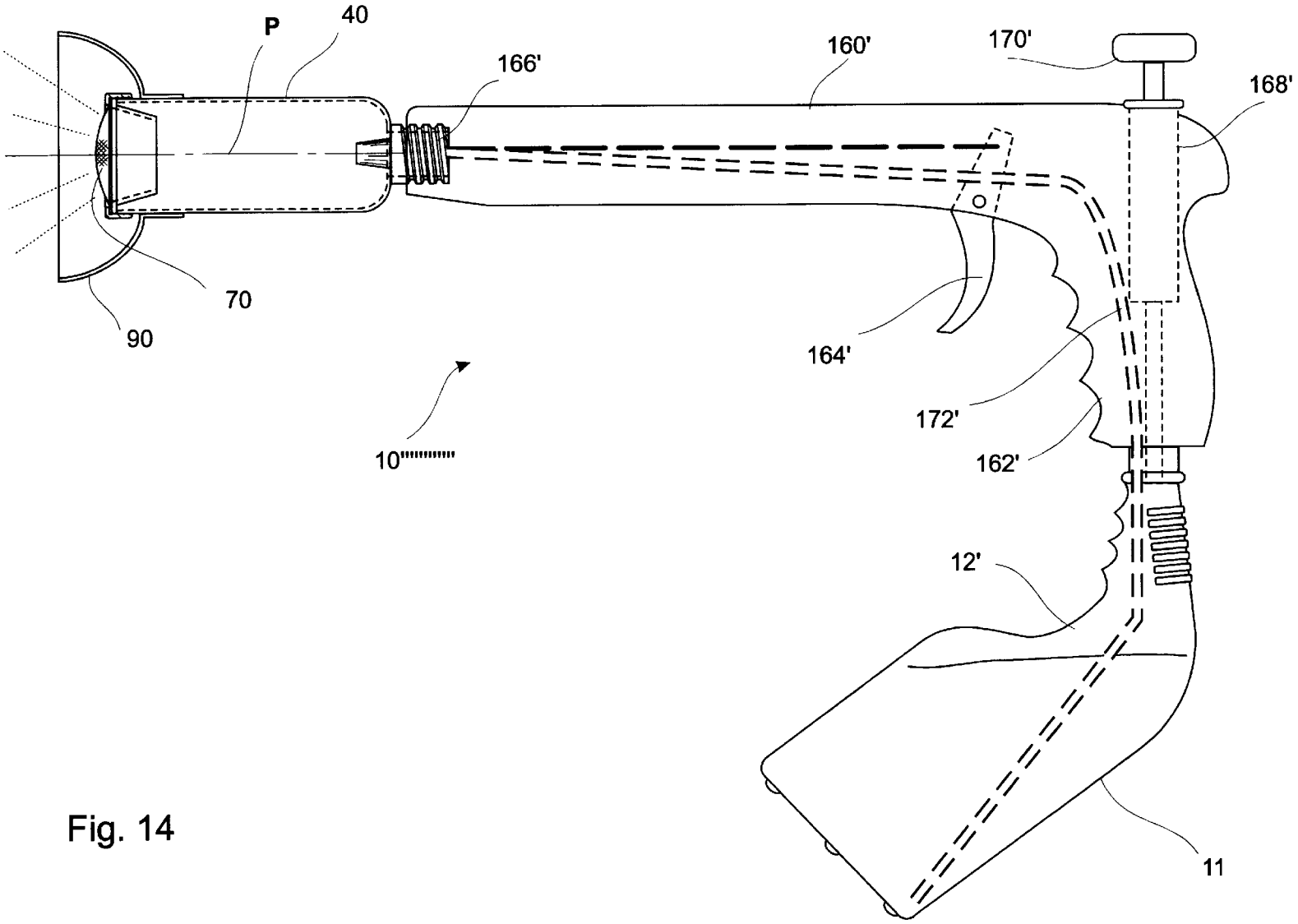
FIG. 14 shows a cross-sectional view of again another embodiment of the invention having an extended handle assembly and an attached pump attached to a chemical reservoir bottle.
Figure 15:
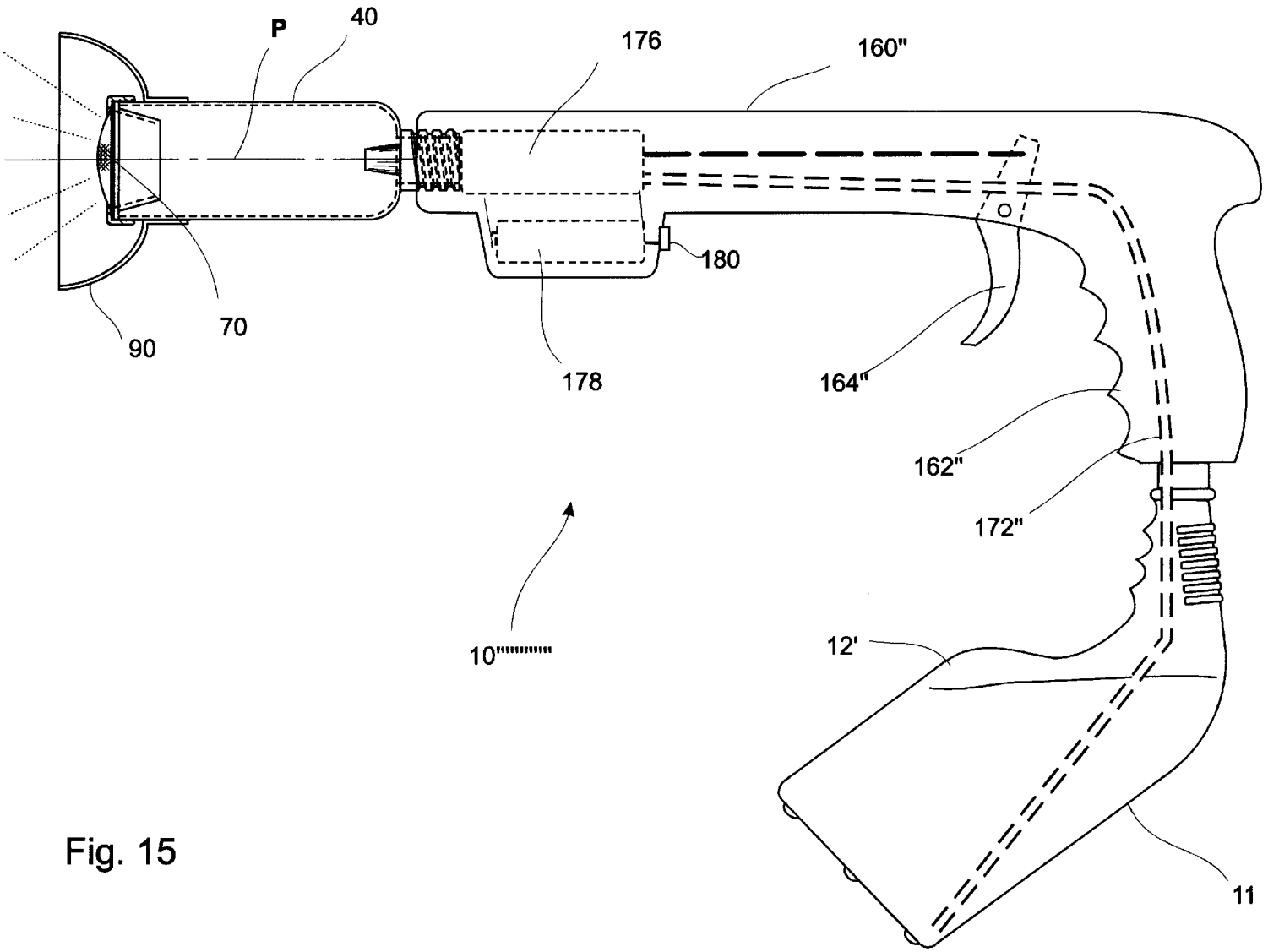
FIG. 15 shows a cross-sectional view of still another embodiment of the invention having an extended handle assembly and an attached battery operated pump attached to a chemical reservoir bottle.

FIG. 14 shows another applicator 10'''''''''''' which differs from that of FIG. 13 in the tank 12'. FIG. 15 shows still another applicator 10'''''''''''''' which differs from that shown in FIG. 14 in that the elongated pump head 160" includes an compressor 176 which is powered by a battery 178, for example, and equipped with a suitable switch 180.

Optionally, applicators with elongated rearward auxiliary handle and trigger assemblies such as those illustrated above may incorporate those assemblies as field removable features to allow for more compact applicator configurations as may be desired. Generally the elongated auxiliary handle and trigger features readily allow the user to avoid bending altogether for most chemical applications. Where these parts are readily removable, as by incorporating threaded cap rings or the like, caps or covers may be provided to seal exposed openings.

In the different embodiments of the invention thus far specifically described herein, pressurized liquid chemicals are delivered to an orifice of a discharging jet or nozzle for ejection as a liquid stream. For this purpose, conventional pressure activated pump head, check valve and pump trigger mechanisms may be used as illustratively described. However, it will be appreciated that other delivery elements are well known and may alternatively be used. For example, liquid chemical pressurization may be alternatively achieved using various conventional hand or motorized pumps, or other gas or liquid pressurization devices, or $CO_2$ cartridges or the like, to build ejection pressures at the ejection port or generally within the liquid chemical reservoir. Liquid chemical ejection may be controlled using various trigger mechanisms to mechanically or electrically activate liquid supply valve or pressure regulated check valve devices in a well known manner.

For example, in variations of the embodiments shown above, the liquid chemical reservoir may alternatively reside within the elongated handle portion of the applicator, obviating the need for an attached reservoir bottle as illustrated. Liquid chemicals could be introduced through a capped opening (not shown) in the upper side of the handle and pressurized in the reservoir using a thumb operated pump, slide valve pump, or other hand operated pump mechanism (not shown). The rearwardly positioned finger actuated trigger could control the liquid chemical ejection by controlling the liquid supply to a discharging jet 22 through an ejection pressure control assembly 24 of the type previously described.

It should be similarly appreciated that the shapes and manner of assembly of the different functional elements of the described embodiments are exemplary and admit of a range of variations. For example, while different threaded connections, collars and cap ring connectors are illustratively described, glued, clamped or friction fittings might also be used. Similarly, integrated componentry can be used and may be advantageous in lowering the cost of manufacturing and simplifying assembly and servicing. The above described embodiments are thus set forth by way of example and not for the purpose of in any way limiting the disclosed invention. It will be readily apparent to those skilled in the art that any number of modifications, derivations and variations can be made to the described embodiments without departing from the scope of the invention as claimed. The claims appended hereto should be accorded their fall scope as including any such modifications, derivations and variations as may be implemented.

What is claimed is:

1. An applicator for delivering a liquid chemical to targeted vegetation, wherein the applicator includes:

a portably unrestricted self contained liquid chemical reservoir connected to a pump head communicably connected to the liquid chemical reservoir, wherein the pump head is capable of discharging the liquid chemical as a stream in a predetermined path;

an extension member having an inner diameter sufficiently spaced from said path to avoid directly contacting the discharged stream of liquid chemical along said predetermined path, and a predetermined length sufficient to provide a well defined stream of liquid therethrough, a first end connectable to said pump head in a relatively fixed position with respect thereto, and a second end connected to said first end, said extension member being generally laterally disposed from a central axis along said predetermined path and substantially over said predetermined length; and a diffuser screen connected to said second end of said extension member and being spaced from said pump head and extending transversely across said predetermined path such that the liquid chemical is dispersed in an expanded pattern sufficient to cover the targeted vegetation upon passing through said diffuser screen.

2. The applicator of claim 1, wherein said diffuser screen has an arcuate shape.

3. The applicator of claim 1, which includes an annular collar connecting said pump head to said wind guard chamber.

4. The applicator of claim 1, which further includes a bent handle extending from said pump head.

5. The applicator of claim 1, wherein said pump head includes a discharging jet.

6. The applicator of claim 1, wherein said extension member is a wind guard chamber.

7. The applicator of claim 6, wherein said wind guard chamber further includes a drip ring disposed on said wind guard chamber adjacent the predetermined path.

8. The applicator of claim 7, wherein said drip ring is disposed inside said wind guard chamber adjacent said second end.

9. The applicator of claim 7, wherein said drip ring includes a drain.

10. The applicator of claim 7, wherein said drip ring is removably disposed on said wind guard chamber.

11. The applicator of claim 6, wherein said wind guard chamber further includes a wind shield connected to said second end of said wind guard chamber adjacent said diffuser screen, wherein said wind shield extends from said second end in a manner to shield liquid chemical from wind as it is dispersed through said diffuser screen.

12. The applicator of claim 6, wherein said wind guard chamber further includes an annular cap ring interconnecting said diffuser screen and said second end of said wind guard chamber.

13. The applicator of claim 1, wherein said stream of liquid chemical impinges upon a central region of said diffuser screen such that said liquid chemical is dispersed in a uniform circular pattern upon passing through said diffuser screen.

14. An applicator for aiding in delivery of a liquid chemical on vegetation, which includes:

a pump head having a discharging jet forwardly disposed thereon, said pump head communicably connected to a self contained portably unrestricted liquid chemical reservoir wherein said pump head is capable of discharging said liquid chemical through said discharging jet in a stream along a predetermined path;

a wind guard chamber having a predetermined length, a first end thereof removably connected to said pump head, and a second end thereof connected to said first end, wherein said wind guard chamber is generally laterally disposed from a central axis along said predetermined path and extends substantially over said predetermined length in a manner to substantially avoid direct contact with said stream; and a diffuser screen having an arcuate shape connected to said second end of said wind guard chamber, and said diffuser screen being sufficiently spaced from said pump head and extending transversely across said predetermined path wherein said stream of liquid chemical impinges upon a central region of said diffuser screen such that said chemical is dispersed in an expanded circular pattern to cover the vegetation upon passing through said diffuser screen.

15. The applicator of claim 14, wherein said wind guard chamber further includes a drip ring disposed on said wind guard chamber adjacent the predetermined path.

16. The applicator of claim 13, wherein said drip ring is disposed inside said wind guard chamber adjacent said second end.

17. The applicator of claim 15, wherein said drip ring includes a drain.

18. The applicator of claim 14, wherein said wind guard chamber further includes a wind shield connected to said second end of said wind guard chamber adjacent said diffuser screen, wherein said wind shield extends from said second end in a manner to shield liquid chemical from wind as it is dispersed from said diffuser screen.

19. The applicator of claim 14, wherein said wind guard chamber further includes an annular cap ring interconnecting said diffuser screen and said second end of said wind guard chamber.

20. The applicator of claim 14, wherein said drip ring is removably disposed on said wind guard chamber.

21. The applicator of claim 14, which includes an annular collar connecting said pump head to said wind guard chamber.

22. The applicator of claim 14, which further includes a bent handle interconnecting said pump head and said chemical reservoir.

23. The applicator of claim 14, wherein said pump head includes a discharging jet forwardly disposed on said head and has a handle and pump trigger rearwardly disposed on said pump head, and wherein said wind guard chamber is removably attached to said pump head.

24. A method of dispersing a liquid chemical onto targeted vegetation comprising the steps of:

(a) ejecting the liquid chemical through an orifice to provide a liquid stream;

(b) passing the liquid stream through a wind guard chamber over a predetermined length in a manner to substantially avoid direct contact with said wind guard chamber;

(c) directing the liquid stream through a diffuser screen which is sufficiently spaced from said orifice such that said liquid stream impinges upon a central region of said diffuser screen such that said liquid chemical is dispersed in an expanded circular pattern upon passing through said diffuser screen causing dispersion of the liquid chemical onto the targeted vegetation.

25. The method of claim 24, in which liquid chemicals exiting the diffuser screen are passed through an annular windshield to protect against wind effects and chemical drift.

26. The method of claim 24, in which liquid chemical drips are retained by a drip ring upstream of the diffuser screen.

* * * * *

UNITED STATES PATENT AND TRADEMARK OFFICE

CERTIFICATE OF CORRECTION

PATENT NO. : 6,145,756
DATED : November 16, 2000
INVENTOR(S) : Corwin Kohls

It is certified that error appears in the above-identified patent and that said Letters Patent is hereby corrected as shown below:

Title page,
Change the inventor's address to -- 989 Patriot Square --.

Claim 16,
Line 1, replace "13" with -- 15 --.

Signed and Sealed this

Eighteenth Day of September, 2001

*Attest:*

Nicholas P. Godici

*Attesting Officer*

NICHOLAS P. GODICI
*Acting Director of the United States Patent and Trademark Office*